US011173367B1

(12) United States Patent
Chancellor

(10) Patent No.: US 11,173,367 B1
(45) Date of Patent: Nov. 16, 2021

(54) CLIMBING HOLDS AND METHOD FOR PACKAGING AND SHIPPING SAME

(71) Applicant: Daniel Chancellor, St. Louis, MO (US)

(72) Inventor: Daniel Chancellor, St. Louis, MO (US)

( * ) Notice: Subject to any disclaimer, the term of this patent is extended or adjusted under 35 U.S.C. 154(b) by 83 days.

(21) Appl. No.: 16/776,756

(22) Filed: Jan. 30, 2020

Related U.S. Application Data

(60) Provisional application No. 62/798,571, filed on Jan. 30, 2019.

(51) Int. Cl.
*A63B 69/00* (2006.01)

(52) U.S. Cl.
CPC ..... *A63B 69/0048* (2013.01); *A63B 2210/50* (2013.01)

(58) Field of Classification Search
CPC . A63B 69/0048; A63B 9/00; A63B 2209/002; A63B 2209/004; A63B 2209/006; A63B 21/00047; A63B 23/035; A63B 23/0375; A63B 27/00; A63B 29/08; A63B 71/0036; A63B 2210/00; A63B 2210/50
See application file for complete search history.

(56) References Cited

U.S. PATENT DOCUMENTS

2014/0357451 A1* 12/2014 Tai ..... A63B 9/00 482/35
2019/0299076 A1* 10/2019 Harrity ..... A63B 23/16
2020/0171369 A1* 6/2020 Sudeith ..... A63B 69/0048

* cited by examiner

*Primary Examiner* — Megan Anderson
(74) *Attorney, Agent, or Firm* — Gary K. Price

(57) ABSTRACT

A climbing hold having a plurality of side panels. Each side panel includes multiple side edges. Along the side edges is a plurality of threaded slots or threaded fasteners. Each of the panels are shipped with the threaded slots formed in the side edges for attaching with the threaded fasteners to form an assembled climbing hold. Each of the side panels are manufactured separately. Once manufactured, each panel is placed generally parallel with one another in the shipping container. The side panels are stacked and packaged in the shipping carton on top of one another so as to be relatively flat and compact for shipping or storage.

16 Claims, 5 Drawing Sheets

CLIMBING HOLDS AND METHOD FOR PACKAGING AND SHIPPING SAME

CROSS REFERENCES TO RELATED APPLICATIONS

U.S. Provisional Application for Patent No. 62/798,571, filed Jan. 30, 2019, with title "Climbing Hold Used On An Artificial Rock Wall And Method For Packaging And Shipping Climbing Holds" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates generally to artificial climbing walls that simulate outdoor rock climbing activity and, more particularly, to climbing holds and method for packaging and shipping the described climbing holds or handholds.

2. Brief Description of Prior Art

Using artificial climbing walls to simulate outdoor rock climbing activity is well known. Generally, a climbing wall is an artificially constructed wall that may be used to practice rock climbing or similar climbing activities. Artificial climbing walls provide rock climbing enthusiasts with the opportunity to simulate outdoor rock climbing activity at an easily accessible location.

Part of the specialized equipment used on artificial rock walls includes climbing holds, often referred to as volumes. Climbing holds are grabbed and stepped on by a climber in order to ascend the wall. The climbing holds are typically of varying shapes and textures that affect the level of skill required to maneuver on the climbing wall. Such climbing holds are typically formed of synthetic material such as polyester resin or polyurethane, but may also be natural materials such as wood or rock.

There are many factors that affect the price of constructing an artificial climbing wall. One factor that affects the cost of the climbing wall is the shipping or distribution costs for the climbing holds. Climbing holds are often packaged and shipped as a one-piece injection molded unit for example, that can be large pieces in size and weight, and consequently, normally require relatively large shipping containers and a relatively large amount of warehouse space to store. The large size of the climbing holds pose a problem for manufacturers transporting the product, and for retailers storing the product.

Accordingly, there is a need for climbing holds that do not suffer from the problems described above. More particularly, there is a need for climbing holds that are structurally robust yet can be packaged and shipped compactly for more efficient shipping and storage. The present invention satisfies these and other needs, and provides further related advantages.

SUMMARY OF THE INVENTION

A climbing hold or volume generally includes a plurality of side panels that form the climbing hold. Each side panel includes multiple side edges and are shipped with fasteners for assembly. When the climbing hold is assembled, the side edges of each side panel are aligned such that a fastener of one side panel engages the adjacent side panel. The fastener is received by the adjacent panel for fastening. Tightening the fastener causes a force to be applied to the fastener as it moves into the adjacent side panel so that the connecting panels are held together securely with no movement.

Each of the side panels are manufactured separately. For each climbing hold to be assembled, there are at least the same number of individual side panels as there are sides of the assembled climbing hold. Once manufactured, each panel is then placed generally parallel with one another in the shipping container. As such, the side panels are stacked and packaged in the shipping container on top of one another so as to be relatively flat and compact for shipping or storage.

DESCRIPTION OF THE PREFERRED EMBODIMENT

Figure 1:
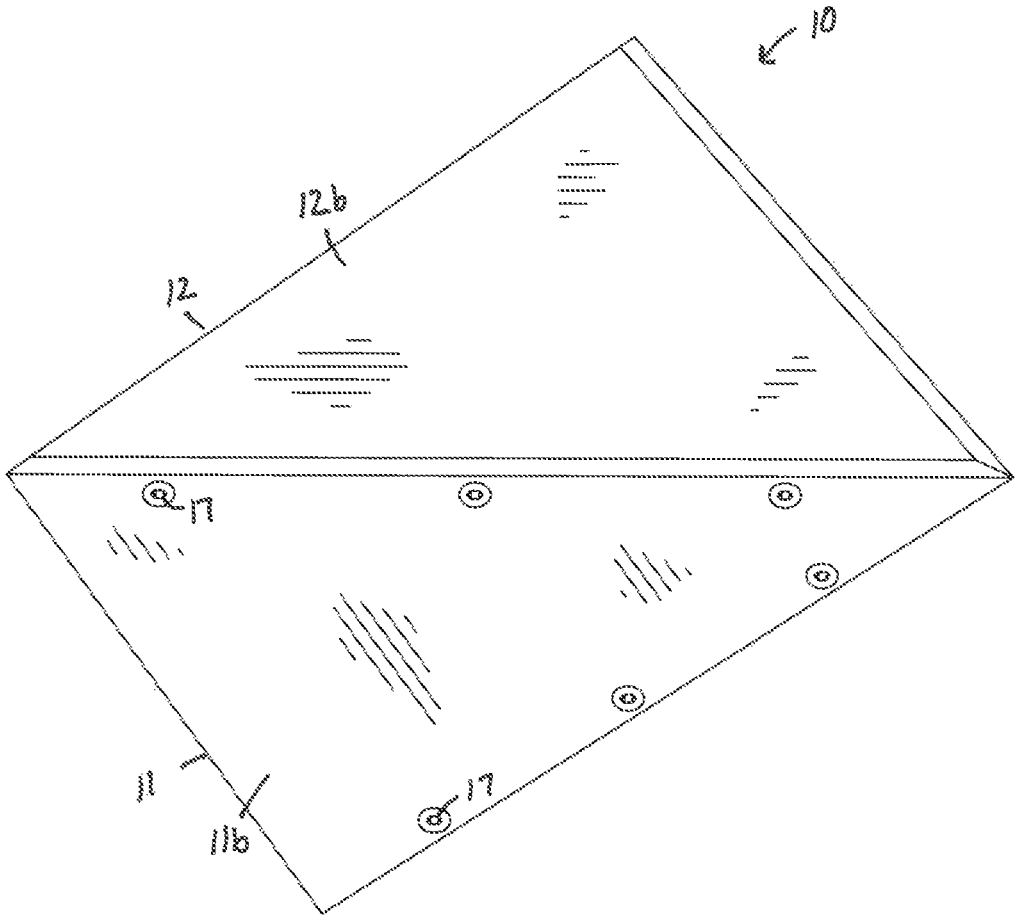
FIG. 1 is a representative sample of a mufti-sided climbing hold that utilizes the method of the present invention.
Figure 2:
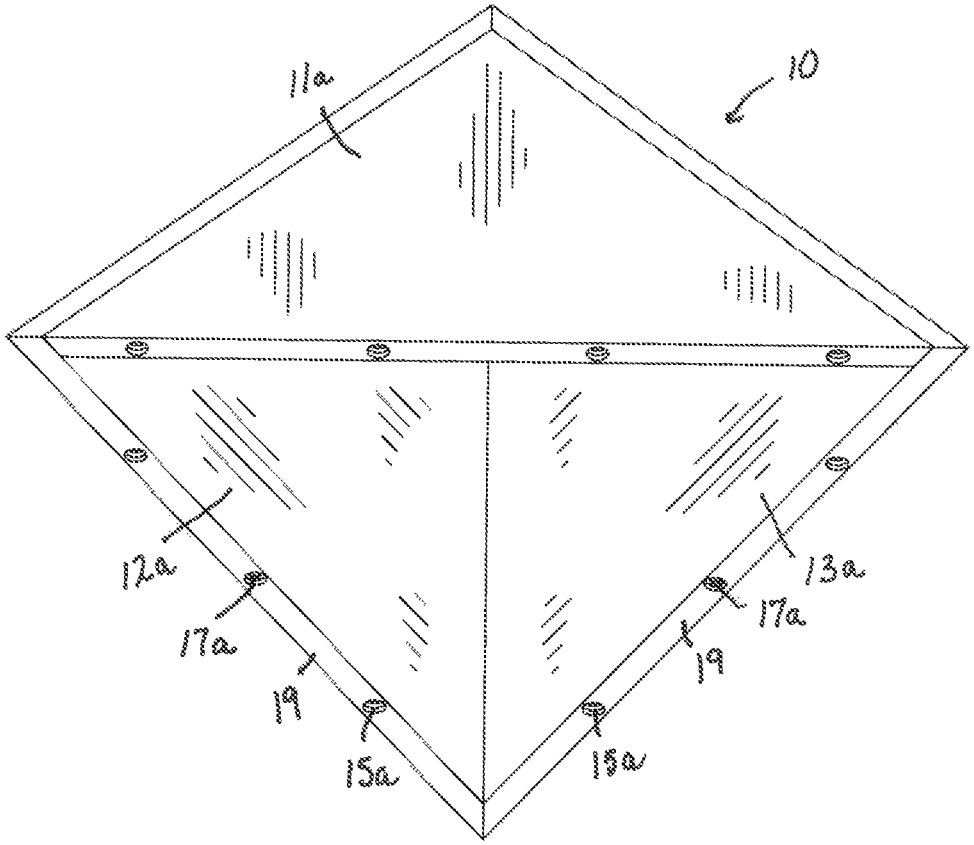
FIG. 2 is a back, perspective view of the climbing hold of FIG. 1.
Figure 3:
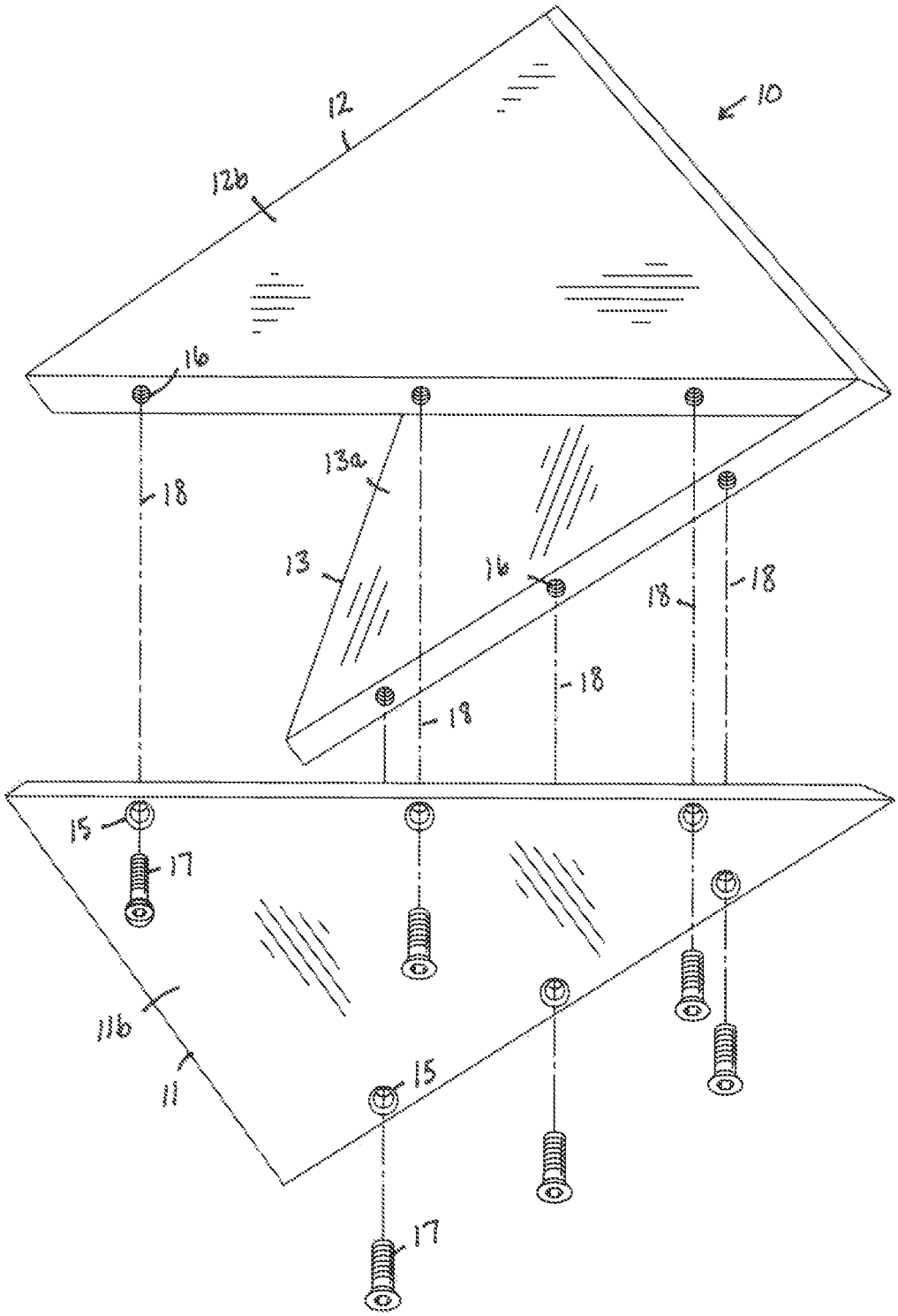
FIG. 3 is an exploded view of the climbing hold of FIG. 1.
Figure 4:
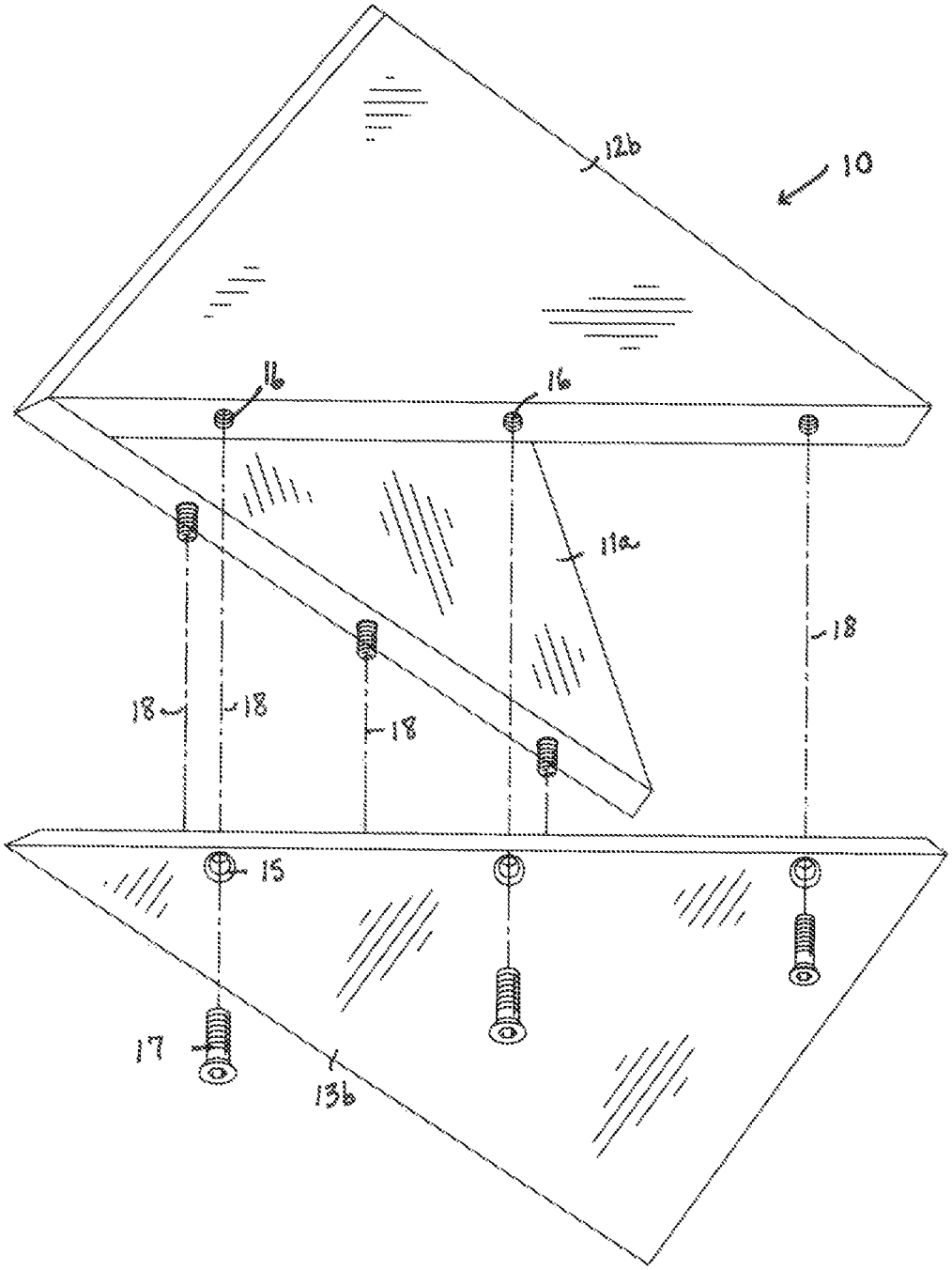
FIG. 4 is an exploded view of the climbing hold of FIG. 1.
Figure 5:
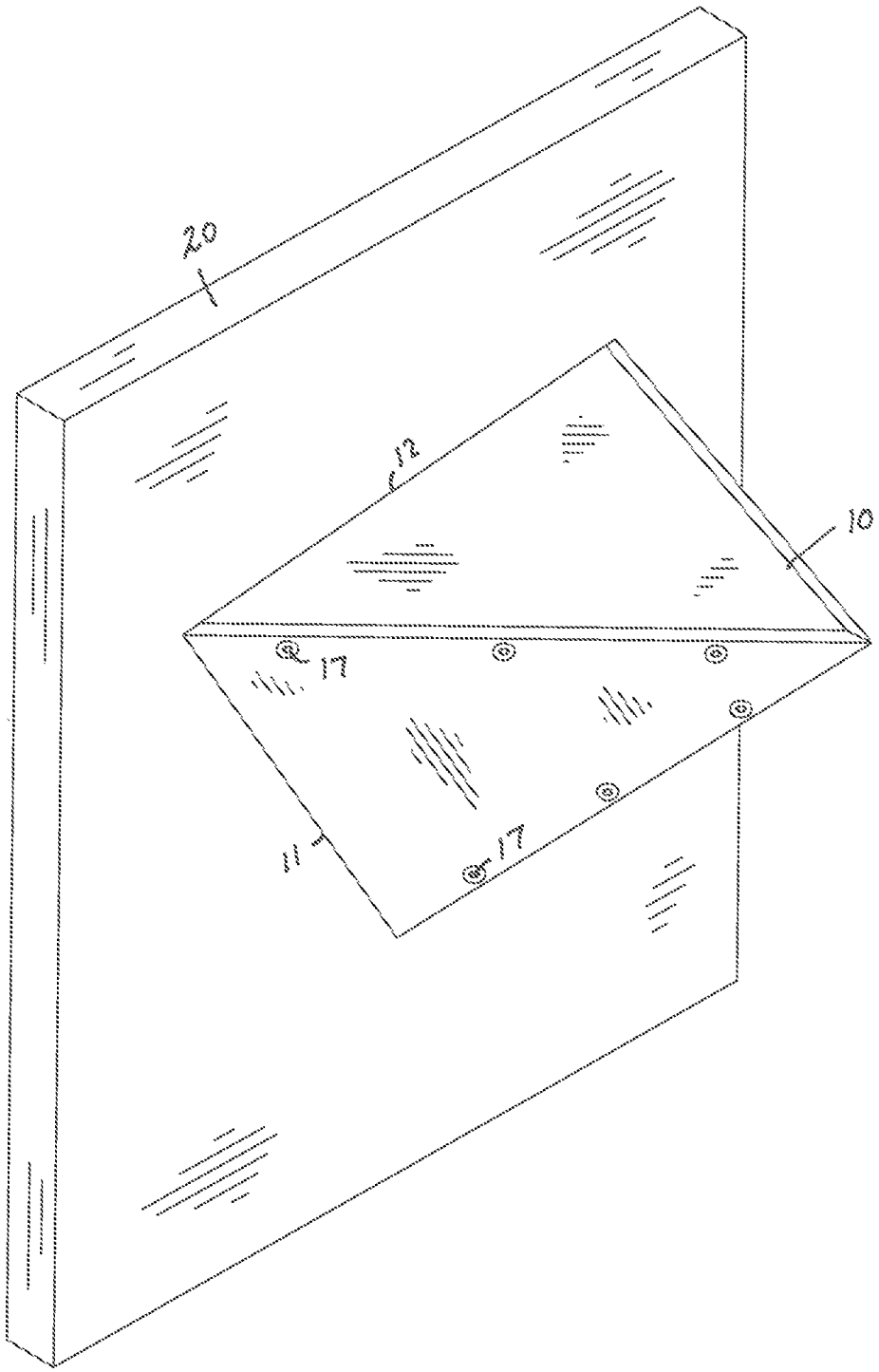
FIG. 5. shows the climbing hold of FIG. 1 attached to a vertical climbing wall.

The present invention involves climbing holds, also referred to as volumes in the industry, used in constructing artificial climbing walls and teaches a method for packaging and shipping a climbing hold. The primary objective of the present invention is to provide a new method for manufacturing, packaging and shipping climbing holds that overcome some of the problems and shortcomings of the prior art. This is accomplished by providing a new method that allows the side panels of the climbing hold to be manufactured separately and then packaged and shipped from the manufacturer to the retailer, climbing gym or end-user in an unassembled state, thereby reducing the size of the shipping container as well as reducing the amount of warehouse space needed for storing. As a result, more units may be transported in each shipment, and more units may be kept in the retailer's inventory, which saves money and space.

From the outset, it should be understood that the present invention relates to climbing holds and primarily to a method for packaging and shipping climbing holds for application with an artificial rock wall. The present invention does not alter the use or application of climbing holds, nor does the present invention claim an assembled climbing hold new in the art. The present invention discloses a unique method for manufacturing, packaging and shipping climbing holds that again, reduces the size of the shipping container and reduces the amount of warehouse space needed for storage.

Referring to the drawings, a climbing hold designated as numeral 10 generally includes a plurality of side panels designated as 11, 12 and 13. As earlier pointed out, climbing holds are typically of varying shapes and sizes and may comprise of more or less than the panels illustrated. As such, while the Figures illustrate a 3-sided climbing hold with varying dimensions, the teachings of the present invention can be used with climbing holds having any number of side panels and dimensions.

As shown, each side panel includes multiple side edges. In the preferred embodiment, along each of the side edges is a plurality of threaded slots 16 or apertures 15 for receiving a threaded fastener 17. As will be understood, each of the panels are shipped with the apertures 15 and/or threaded slots 16 formed in the side edges. The threaded slots 16 for attaching with the threaded fasteners 17 as will be further discussed.

In the illustrated embodiment, the slots or fasteners are spaced equidistant from one another along each of the side edges however, other embodiments can include more or less slots or fasteners or a different spacing between each of the slots or fasteners. For example, rather than using threaded slots and fasteners as described, one side panel may include fasteners and the adjacent side panel include a defined area such as the side edge (without slots) for receiving the fasteners.

Moreover, and as illustrated, the number and placement or location of pre-drilled apertures 15 align 18 with the number and placement of threaded slots 16 when the side panels are assembled.

Each aperture 15 is sized and shaped for receiving a fastener 17 and, each threaded slot 16 is sized and shaped for fixedly receiving the fastener 17. In particular, each threaded slot 16 has a length and width that corresponds to the length and width of the fastener 17.

Each of the side panels include an interior face 11*a*,12*a* and 13*a*, and an exterior face 11*b*,12*b* and 13*b*. In this embodiment, the exterior face of each of the side panels has a preferred finish or texture overlay while the interior face is preferably smooth without a finish.

The threaded slots 16 are sized to receive and retain the fasteners 17 of the panels, as described above, to fasten and retain one side panel with the adjacent side panel. As such, the number and placement or location of each threaded slot 16 align 18 with the number and placement of fasteners 17 when the side panels are assembled.

As illustrated, the fastener 17 is preferably accessible and extends from the exterior face of the side panel, preferably through the side edge. It should be understood however that the fastener 15 may, in the alternative, extend from the interior face of the side panel, and through the side edge of the adjacent side panel.

When the climbing hold is assembled with the side panels, the side edges of each side panel are aligned such that a fastener of one side panel engages the adjacent side panel as described. The fastener 17 is inserted into the threaded slot 16 of the respective panel for fastening. Tightening the fastener causes a force to be applied to the fastener as it moves into the pre-drilled threaded slot 16.

Each threaded slot 16 defines a groove that is curved with a radius that matches the radius of the fastener 17. In this embodiment, the threaded slots 16 are dimensioned to receive the support fasteners 17 tightly or with a friction fit, such that the connecting panels are held together securely with no movement.

As discussed, each of the side panels are manufactured separately. For each climbing hold to be assembled, there are at least the same number of individual side panels as there are sides of the assembled climbing hold.

Once the climbing hold 10 is assembled as discussed, the assembled climbing wall is configured to attach to the vertical climbing wall 20 using an appropriate wall fastener. As Illustrated, the back of the climbing hold 10, that portion of the climbing hold that abuts the vertical climbing wall 20, is preferably open. In one embodiment, at least one outside edge 19 of the assembled climbing hold 10 includes multiple edge apertures 15*a* for receiving a wall fastener 17*a* for releasably attaching the climbing hold 10 to the vertical climbing wall 20.

In practicing the present invention, once manufactured, a protective wrapping may be placed around each side panel for shipping. Each wrapped panel can then be placed generally parallel with one another in the shipping container. As such, the side panels are stacked and packaged in the shipping container on top of one another so as to be relatively flat and compact for shipping or storage.

Although the above description above contains many specificities, these should not be construed as limiting the scope of the invention but as merely providing illustrations of some of the presently preferred embodiments of this invention. Thus the scope of the invention should be determined by the appended claims in the formal application and their legal equivalents, rather than by the examples given.

I claim:

1. A climbing hold comprising:

at least one set of side panels consisting of a first side panel and a separate, adjacent side panel, where each of the first and separate, adjacent side panels include side edges, and wherein each of the side edges selectively includes either a plurality of threaded slots or a plurality of apertures for receiving a threaded fastener, said plurality of threaded slots configured for attaching with the threaded fasteners, and wherein placement of said plurality of apertures on the first side panel align with placement of said plurality of threaded slots on the separate, adjacent side panel so that the side edges of the first and separate, adjacent side panels align and the fastener of the separate, adjacent side panel engage the plurality of threaded slots of the first side panel forming an assembled climbing hold, each of said first and separate, adjacent side panels include an interior face and an exterior face where the exterior face of each of the first and separate, adjacent side panels has a preferred finish, said fastener is accessible and extends from the separate, adjacent side panel through the side edges of the first side panel, wherein tightening the fastener causes a force to be applied to the fastener as it moves into the plurality of threaded slots, and wherein said assembled climbing hold further defines at least one outside edge for receiving a wall fastener for releasably attaching the assembled climbing hold to a vertical climbing wall, and wherein the assembled climbing hold defines an open back side.

2. The climbing hold of claim 1, wherein a protective wrapping is configured to be placed around each of the front and separate, adjacent side panels for shipping.

3. The climbing hold of claim 2, wherein each of the first and separate, adjacent side panels is placed parallel with one another in a shipping container.

4. The climbing hold of claim 3, wherein each of the first and separate, adjacent side panels are stacked and packaged in the shipping container on top of one another so as to be flat and compact for shipping or storage.

5. The climbing hold of claim 1, wherein said fasteners is accessible and extends from the exterior surface of the separate, adjacent side panel through the side edges of the first side panel.

6. The climbing hold of claim 1, wherein said fasteners is accessible and extends from the interior surface of the separate, adjacent side panel through the side edges of the first side panel.

7. A climbing hold comprising:

at least one set of side panels consisting of a first side panel and a separate, adjacent side panel, where each of the first and separate, adjacent side panels include multiple side edges, and wherein each of the multiple side edges includes either a plurality of fasteners or an area for receiving said plurality of fasteners such that the plurality of fasteners of the separate, adjacent side panel engage said area of the first side panel forming an assembled climbing hold, each of said first and separate, adjacent side panels include an interior face and an exterior face where the exterior face of each of the first and separate, adjacent side panels has a preferred finish, and wherein said assembled climbing hold configured for receiving a wall fastener for releasably attaching the assembled climbing hold to a vertical climbing wall, and wherein the assembled climbing hold defines an open back side.

8. The climbing hold of claim 7, wherein a protective wrapping is configured to be placed around each of the first and separate, adjacent side panels for shipping.

9. The climbing hold of claim 8, wherein each of the first and separate, adjacent side panels is placed parallel with one another in a shipping container.

10. The climbing hold of claim 9, wherein each of the first and separate, adjacent side panels are stacked and packaged in the shipping container on top of one another so as to be flat and compact for shipping or storage.

11. The climbing hold of claim 8, wherein each of said plurality of fasteners are accessible and extend from the exterior face of the separate, adjacent side panel through the multiple side edges of the first side panel.

12. The climbing hold of claim 11, wherein tightening each of the plurality of fasteners from the exterior face causes a force to be applied to each of the plurality of fasteners as it moves into the plurality of slots of the first side panel.

13. The climbing hold of claim 8, wherein each of said plurality of fasteners are accessible and extend from the interior face of the separate, adjacent side panel through the multiple side edges of the first side panel.

14. The climbing hold of claim 13, wherein tightening each of the plurality of fasteners from the interior face causes a force to be applied to each of the plurality of fasteners as it moves into the plurality of slots.

15. The climbing hold of claim 7, wherein said area for receiving said plurality of fasteners includes a plurality of slots for receiving said plurality of fasteners, and where each of the plurality of slots defines a groove that is curved with a radius that matches the radius of the plurality of fasteners.

16. The climbing hold of claim 15, wherein the plurality of slots are dimensioned to receive the plurality of fasteners tightly and with a friction fit such that the first and separate, adjacent panels are held together securely with no movement.

* * * * *